United States Patent [19]

Moor

[11] 4,391,456

[45] Jul. 5, 1983

[54] SKI STICK GRIP

[76] Inventor: Beat Moor, Meiringen Halteli CH3860, Switzerland

[21] Appl. No.: 233,605

[22] PCT Filed: May 13, 1980

[86] PCT No.: PCT/CH80/00058

§ 371 Date: Feb. 7, 1981

§ 102(e) Date: Jan. 22, 1981

[87] PCT Pub. No.: WO80/02649

PCT Pub. Date: Dec. 11, 1980

[30] Foreign Application Priority Data

Jun. 7, 1979 [CH] Switzerland ..... 5292/79

[51] Int. Cl.[3] ..... A63C 11/22

[52] U.S. Cl. ..... 280/821

[58] Field of Search ..... 280/821, 822, 816; 135/72, 65, 76; D21/229; D8/315, 307; D12/174, 177

[56] References Cited

U.S. PATENT DOCUMENTS

| | | | |
|---|---|---|---|
| D. 194,834 | 3/1963 | Parker et al. | D8/307 |
| D. 231,043 | 3/1974 | Barnett | D8/307 |
| 2,031,384 | 2/1936 | Oliver | 135/65 |
| 3,085,814 | 4/1963 | Scott | 280/821 |
| 3,245,686 | 4/1966 | Hartmeister | 273/81.3 |
| 3,879,048 | 4/1975 | Penny | 280/821 |
| 4,288,101 | 9/1981 | Aho | 280/821 |

*Primary Examiner*—David M. Mitchell

*Attorney, Agent, or Firm*—Saul Jecies

[57] ABSTRACT

A ski stick grip, comprising a T-shaped part, the two arms of the T being symmetrically placed. The middle part of the T is shaped as a surface for the application of the hand and is enlarged in the direction of the T arms. The transition to the T arms is adapted to the shape of the hand and the thumb grip. The upper extremity of the grip with the two arms is built up into a pommel to take the bent fingers of the hand.

4 Claims, 4 Drawing Figures

SKI STICK GRIP

The invention relates to a ski stick grip, the lower part of which is shaped like a sleeve which fits round the top end of the ski stick.

Figure 1:
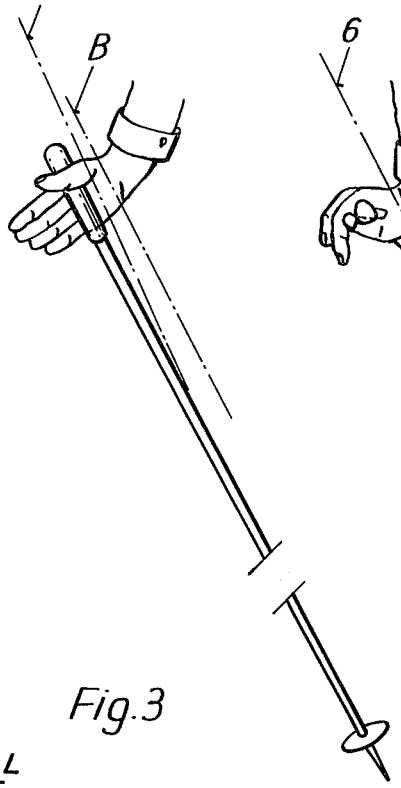
PRIOR ART Fig. 1

The usual ski stick grips have a cylindrical body, rounded at the upper end, and placed like a sleeve over the top end of the ski stick (FIG. 1). A grip of this kind has to be firmly gripped by the hand so that the necessary force (A) which is applied sideways to the stick and therefore indirectly in the direction in which the stick is applied, can be transmitted to the ski stick. In this type of operation of the ski stick, the wrist is move round an axis of rotation at right angles to the surface of the hand. Having to hold tightly onto the grip is, after a time, very fatiguing to the muscles of the hand. In this process, the force is transmitted indirectly through friction to the ski stick. It is particularly tiring to move the wrist at right angles to the surface of the hand. Transmitting force from the arm to the usual ski stick grip causes a relatively large force (B) to be applied to the wrist, and this has to be taken up by the arm and hand muscles. The consequences of this are fatigue, inflammation and damage to the wrist.

When a hand loop is fixed to the top of the grip body, the hand grip does not need to be so powerful, but all the more load is applied to the bottom edge of the hand, and the strain on the wrist joint is equally unpleasant.

The task of the inventor was therefore to create a ski stick grip, in particular for Nordic, Alpine and Touring skiers, with which the hand is as far as possible horizontal on the grip, and with which the force of the hand is applied to the grip over a larger area more adapted to the physiology of the hand and, as far as possible, in the direction of the longitudinal axis of the ski stick, which means that the movement of the wrist joint is less rigid and more comfortable, since the wrist moves round an axis of rotation parallel to the surface of the hand and at right angles to the forearm, so that there is significantly less fatigue in the arms, the hands and particularly in the wrists, and so that the force of the arm and the wrist is better and more directly transmitted to the stick.

This task was achieved by the invention of a ski stick grip which has the following characteristics in the distinguishing characteristics part of Patent Claim 1.

Figure 2:
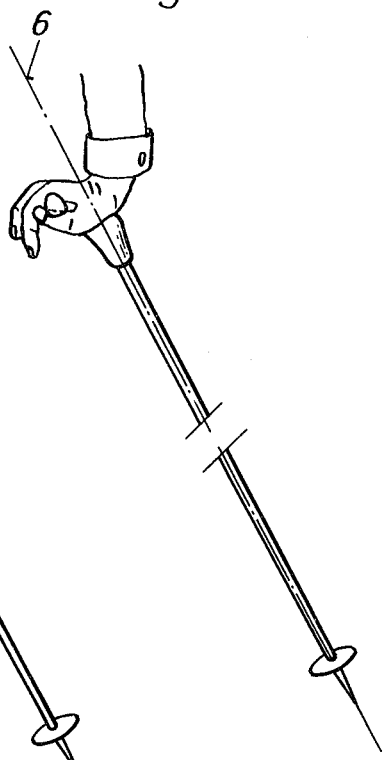
Figure 3:
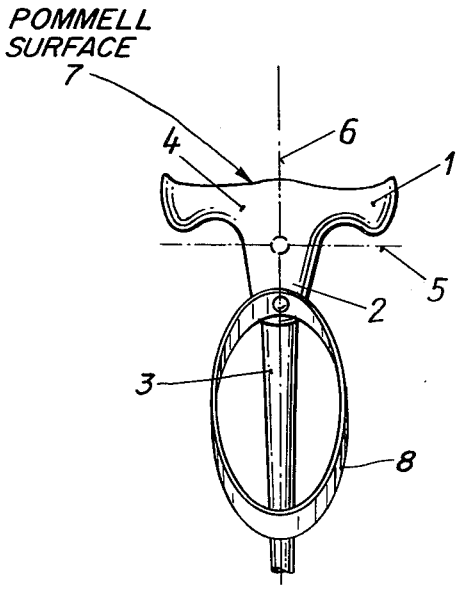

The drawings show the manipulation of the usual ski stick grip, and an applied example of the object of the invention. They show:

FIG. 1 the manipulation of the usual ski stick,

FIG. 2 the manipulation of the inventor's ski stick grip,

FIG. 3 is a view of the new ski stick grip in the direction of the arm and

Figure 4:
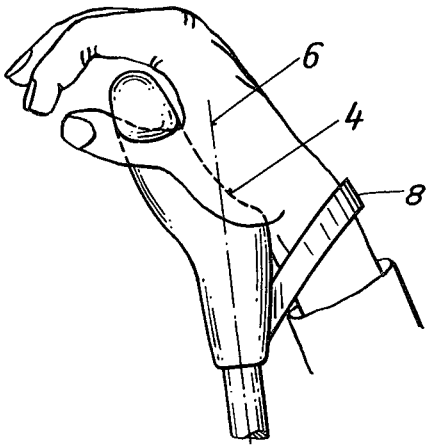

FIG. 4 the new ski stick grip, held in the hand, side view, sideways to the direction of the arm.

The ski stick grip shown is T-shaped (FIG. 3) and the two arms 1 of the T are symmetrically placed. The lower part of the middle section of the T 2 is sleeve-shaped to fit over the upper end of the ski stick 3. The intermediate part of the middle section of the T 2 is shaped as a surface for the application of the hand 4 in such a way that as great a part as possible of the inner surface of the hand lies against the grip. It lies against the T arm 1 and is inclined in the direction of the ski stick axis 6 (FIG. 4) so that in operating the stick the hand is moving essentially in the horizontal position. The wrist joints move round an axis 5, which is parallel to the surface of the hand and at right angles to the forearm (FIG. 3).

The surface for applying the hand 4 is extended in the direction of the T arms and the extension to the T arms 1 is anatomically adapted to the shape of the hand and the thumb grip (FIGS. 3 and 4). The upper extremity of the ski stick grip is built up into a pommel with the two T arms 1 to take the bent fingers of the hand. The transmission of force to the axis 6 of the ski stick 3 is achieved in a comfortable manner, partly through the pressure of the hand surface, partly through the pull of the fingers.

A hand loop (not shown) may be provided round the middle part 2 of the T, and this allows the ski stick 3 to be comfortably pulled back.

The upper extremity of the grip with the two T arms 1 (the pommel), may be ridged to locate and extend the grip area for the fingers.

The surface 4 for applying the hand can be provided with a pommel (not shown) extending upwards and the two T arms 1 can be placed asymmetrically.

The ski stick grip described is particularly suitable for Nordic, Alpine and Touring skiers, and permits considerably improved performance without extra effort, since the power is applied directly and exactly in the direction of application of the stick.

I claim:

1. A ski stick grip attached to a ski stick having a center portion, two side portions of substantially equal length extending from the said center portion at right angles to the longitudinal axis of the ski stick, an upper surface and a lower surface in which the force of the hand is applied substantially in the direction of the longitudinal axis of said ski stick, permitting the movement of the wrist joint substantially parallel to the movement of the hand and at right angles of the forearm to increase the force applied by the arm and the wrist to said stick;

said ski stick grip enabling the placing of the palm of the hand on said upper surface;

said lower surface arranged for accommodating the thumb of the hand, allowing the hand to surround said grip by forming substantially a fist;

said upper surface being extended outwardly and upwardly;

said lower surface of said ski stick grip curved downwardly; and a pommel formed, extending upwardly substantially from the center portion of said grip;

allowing the force on the ski stick grip to be exerted substantially parallel to the longitudinal axis of the ski stick.

2. A ski stick grip as claimed in claim 1, additionally comprising a hand loop.

3. A ski stick grip as claimed in claim 1 wherein the grip is inclined forwardly in relation to the longitudinal axis of said ski stick.

4. A ski stick grip as claimed in claim 1 being substantially of T-shaped configuration; the upright portion of the T being secured at its lower end to said ski stick.

* * * * *